US006178763B1

(12) United States Patent
Brancheau et al.

(10) Patent No.: US 6,178,763 B1
(45) Date of Patent: Jan. 30, 2001

(54) HINGED POCKET THERMAL BREAKER AND REFRIGERATION UNIT

(75) Inventors: Harry A. Brancheau; Dan G. Hopkins, both of Inman, SC (US); Thomas E. Yingst, Los Angeles, CA (US); Michael A. Branz, Spartanburg, SC (US)

(73) Assignee: Specialty Equipment Companies, Inc., Aurora, IL (US)

( * ) Notice: Under 35 U.S.C. 154(b), the term of this patent shall be extended for 0 days.

(21) Appl. No.: 09/411,606

(22) Filed: Oct. 1, 1999

Related U.S. Application Data

(60) Provisional application No. 60/104,003, filed on Oct. 13, 1998.

(51) Int. Cl.[7] ..... F25D 21/06
(52) U.S. Cl. ..... 62/275; 219/536
(58) Field of Search ..... 62/275, 80, 152; 219/385, 386, 402, 404, 536; 312/406, 406.1, 406.2

(56) References Cited

U.S. PATENT DOCUMENTS

D. 416,713 11/1999 Trulaske, Sr. .
3,895,500 * 7/1975 Barton et al. ..... 62/275
4,332,142 * 6/1982 Prada ..... 62/275
4,548,049 * 10/1985 Rajgopal ..... 62/275
4,588,235 5/1986 Barroero .

* cited by examiner

*Primary Examiner*—William E. Tapolcai
*Assistant Examiner*—Mohammad M Ali
(74) *Attorney, Agent, or Firm*—Dority & Manning, P.A.

(57) ABSTRACT

A refrigeration unit with a thermal break member and an anti-sweat heating mechanism in the form of a heater wire suitable for high humidity environments is provided. The thermal break member includes a main body portion and a conduit portion connected to the main body portion. The conduit portion defines a channel disposed near the access opening of the refrigerated compartment and configured to receive therein the heater wire. The thermal break member includes a closure member and a flexible hinge portion. The flexible hinge portion has a first end connected to the main body portion and a second end connected to the closure member. A typical value for the durometer of the flexible hinge portion is 70 Shore A, and a typical value for the durometer of the main body portion and the closure member is 80 Shore D.

17 Claims, 11 Drawing Sheets

HINGED POCKET THERMAL BREAKER AND REFRIGERATION UNIT

PRIORITY CLAIM

The present application hereby claims priority based on provisional application serial number 60/104,003, filed on Oct. 13, 1998.

BACKGROUND OF THE INVENTION

The present invention relates to a refrigeration unit with a thermal breaker and to the thermal breaker itself. More particularly, the present invention relates to a refrigeration unit with a thermal breaker that is a component used in preventing condensation from forming on the outer shell of the refrigeration unit in high humidity environments.

As known, the refrigerated wall of the refrigerated compartment of a refrigeration unit is maintained at a much lower temperature than the atmosphere outside the refrigerated compartment. As shown in FIGS. 2A, 2B and 2C, the outer shell of a typical refrigeration unit includes exterior panels 13 formed of a layer of sheet metal. As shown in FIGS. 2A, 2B and 2C, a metal panel 15 defines an inside surface the refrigerated compartment. A metal panel 16 forms a border around the opening of the refrigerated compartment and is exterior to the refrigerated compartment but in close proximity to panel 15. The panels 13, 15 and 16 encase heat-insulating material 14 to form the heat-insulating walls of the refrigeration unit.

Since metal evenly conducts heat, a continuous metal panel extending both inside the refrigerated compartment and outside the refrigerated compartment as part of a heat-insulating wall of the refrigerated unit would tend to maintain itself at the same equilibrium temperature. As shown in FIGS. 2A, 2B and 2C, a thermal break member 17 is fitted as a part of the refrigeration unit that connects compartment panel 15 with front panel 16. Moreover, thermal break member 17 is formed of material that is a poor conductor of heat. Rigid polyvinylchloride is a typical material for forming thermal break member 17.

In environments where the refrigeration unit is subjected to high humidity, as shown in FIGS. 2A, 2B and 2C, a so-called anti-sweat heater wire 18 is provided and disposed to contact front panel 16. The purpose of such wire 18 is to keep front panel 16 warm enough to prevent condensation from forming on the exterior surface of panel 16. As shown in FIGS. 2A and 2C, sometimes heater wire 18 is nestled within a conduit that is formed at least in part by thermal break member 17. In FIG. 2A, the conduit housing heater wire 18 is formed in part by a forward lip portion 19 of thermal break member 17 and a recessed portion of front panel 16. As shown in FIG. 2B, the conduit is formed by a length of tape 26 that adheres heater wire 18 to the inside surface of front panel 16. As shown in FIG. 2C, thermal break member 17 is formed by two interlocking components 20 and 21. The conduit is formed in part by a forward lip portion 19 of an interlocking cap component 21, a forward edge of an interlocking panel component 20 and a flange portion 22 of front panel 16 wherein flange portion 22 is disposed at a right angle with respect to front panel 16 and parallel to inner panel 15.

Arrangements such as shown in FIGS. 2A, 2B and 2C are effective in preventing condensation from forming on the exterior surface of front panel. 16 of a refrigeration unit so long as electric current can be provided to flow through heater wire 18. However, circumstances can cause malfunctions of heater wire 18, and require replacement of same. For example, a power surge could burn out a portion of heater wire 18, or heater wire 18 could merely wear out. Once heater wire 18 malfunctions, condensation forming on the exterior surface of front panel 16 would alert the repairman of the need to replace heater wire 18.

Replacement of heater wire 18 is a major undertaking for each of the configurations shown in FIGS. 2A, 2B and 2C. In the embodiment shown in FIG. 2A for example, thermal break member 17 must be removed by applying force against the inside edge 23 via a block 24 of wood and using a hammer 25 to strike the block 24. In this way, lip portion 19 of thermal break member 17 is forced to move away from the recess of front panel 16 and thereby expose heater wire 18 so that heater wire 18 can be replaced. Upon replacement of heater wire 18, block 24 must be placed against lip portion 19 and struck with hammer 25 to reposition thermal break member 17 back into its prior orientation as part of the wall of the refrigeration compartment. In some instances, too much damage is done to the original thermal break member 17 for it to be reused, and a new piece of thermal break member 17 must be used to replace the damaged member.

In the FIG. 2B embodiment, rigid polyurethane foam 14 is molded in place after heater wire 18 is attached via adhesive tape 26 to the inside surface of front panel 16. If heater wire 18 malfunctions, it cannot be replaced without destroying thermal break member 17 and removing polyurethane foam 14 from within the compartment wall. Once heater wire 18 is replaced, polyurethane foam must be reintroduced, and a replacement thermal break member 17 must be provided and re-inserted as part of the wall of the refrigerated compartment. This replacement process is very labor-intensive and time consuming and cannot be done in the field.

In the FIG. 2C embodiment, thermal break member 17 comprises two interlocking components 20 and 21. Panel component 20 is configured in a manner similar to thermal break member 17 shown in FIG. 2B. However, panel component 20 is provided with a portion that faces toward the refrigerated compartment when disposed to connect between inside panel 15 and front panel 16. The inner portion of panel component 20 is configured to receive thermal break cap component 21 so that cap component 21 mechanically attaches in a friction fit to panel component 20. Moreover, when cap component 21 is attached to panel component 20, a conduit is formed to receive heater wire 18 therein. This conduit that receives heater wire 18 is formed in part by compartment panel 15, thermal break cap 21, and panel component 20. Replacement of heater wire 18 requires disengagement of thermal break cap 21 from panel component 20 of thermal break member 17. This is accomplished by inserting a wedge such as a screwdriver blade between compartment panel 15 and the edge of thermal break cap 21 and prying thermal break cap 21 away from the friction fit interlock with panel component 20. Once thermal break cap 21 is removed, malfunctioning heater wire 18 can be removed and replaced with a new heater wire 18. Thereafter thermal break cap 21 can be reinserted over panel component 20 and locked thereto by the application of sufficient force to deform the mating components of panel component 20 and thermal break cap 21 until they interlock with one another. Replacement of heater wire 18 in the FIG. 2C embodiment can be accomplished without destroying thermal break member 17 and in a much faster manner than is possible with the embodiments shown in FIG. 2A or FIG. 2B. However, the two-piece thermal break member 17 shown in FIG. 2C is much more expensive to manufacture due to the need for precise tolerances in order to effect the proper interlock between the two components 20 and 21. Moreover, the assembly process for the refrigeration unit requires an additional step to attach the thermal break cap 21 to panel component 20. In addition, manufacturing of the refrigeration unit is rendered more complicated and therefore more costly due to the need to inventory two separate components 20 and 21 for thermal break member 17 in the FIG. 2C embodiment.

Thus, a need exists to provide a thermal break member that is less costly to install and maintain, and at the same time facilitates replacement of the heater wire in a manner that is economical. Such replacement should be capable of being done with relatively little skill by the repairing personnel, without requiring large amounts of the repair person's time, and without destruction of the thermal break member in the process of replacement of the heater wire.

OBJECTS AND SUMMARY OF THE INVENTION

It is a principal object of the present invention to provide a refrigeration unit suitable for high humidity environments and allowing for economical replacement of an anti-sweat heating mechanism in the form of a heater wire.

It is another principal object of the present invention to provide a refrigeration unit suitable for high humidity environments and configured to allow field technicians to replace at the site of the refrigeration unit, an anti-sweat heating mechanism in the form of a heater wire.

It is a further object of the present invention to provide a refrigeration unit with a thermal break member and an anti-sweat heating mechanism in the form of a heater wire suitable for high humidity environments wherein the thermal break member is configured to allow economical replacement of the heater wire.

It is yet another object of the present invention to provide a refrigeration unit with a thermal break member and an anti-sweat heating mechanism in the form of a heater wire suitable for high humidity environments wherein the thermal break member is configured to allow economical manufacture of the refrigeration unit as well as economical replacement of the heater wire.

It is a still further object of the present invention to provide a refrigeration unit with a thermal break member and an anti-sweat heating mechanism in the form of a heater wire suitable for high humidity environments wherein the thermal break member is configured to allow repair technicians to replace the heater wire while the refrigeration unit is on site in the high humidity environment.

It is yet another object of the present invention to provide a thermal break member that is configured to accomplish the foregoing objects of the invention.

Additional objects and advantages of the invention will be set forth in part in the description which follows, and in part will be obvious from the description, or may be learned by practice of the invention. The objects and advantages of the invention may be realized and attained by means of the instrumentalities and combinations particularly pointed out in the appended claims.

To achieve the objects and in accordance with the purpose of the invention, as embodied and broadly described herein, a preferred embodiment of the refrigeration unit with a thermal break member and an anti-sweat heating mechanism in the form of a heater wire suitable for high humidity environments of the present invention comprises a cabinet and a refrigerated compartment disposed within the cabinet and defining an access opening. The access opening is configured and disposed to provide access to the refrigerated compartment. The unit further includes refrigeration equipment that is configured to refrigerate said refrigerated compartment. The refrigeration equipment is disposed within the cabinet and thermally isolated from the refrigerated compartment. At least one compartment panel defines a portion of the refrigerated compartment disposed near the access opening. At least one cabinet panel defines a portion of the cabinet and is disposed near the access opening.

A thermal break member in accordance with the present invention is provided as part of the refrigeration unit of the present invention. The thermal break member of the invention is configured and disposed to connect the at least one compartment panel and the at least one cabinet panel near the access opening. The thermal break member includes a main body portion and a conduit portion connected to the main body portion. The conduit portion defines a channel disposed near the access opening and configured to receive therein the heater wire. The thermal break member of the present invention includes a closure member and a flexible hinge portion. The flexible hinge portion has a first end connected to the main body portion and a second end connected to the closure member.

The main body portion, the flexible hinge portion and the closure member of the thermal break member are preferably configured in a unitary construction. The conduit portion also is preferably configured in a unitary construction with the main body portion, the flexible hinge portion and the closure member. In a presently preferred embodiment of the thermal break member of the present invention, a typical value for the durometer of the flexible hinge portion is 70 Shore A, and a typical value for the durometer of the main body portion and the closure member is 80 Shore D.

The closure member is configured and to be selectively movable about the flexible hinge portion between an open position and a closed position. The closure member secures the channel so as to retain therein any heater wire received therein when the closure member is disposed in the closed position. The closure member permits access to the channel so as to permit replacement of the heater wire configured to be received therein when the closure member is disposed in the open position.

DETAILED DESCRIPTION OF THE PREFERRED EMBODIMENTS

Figure 1:
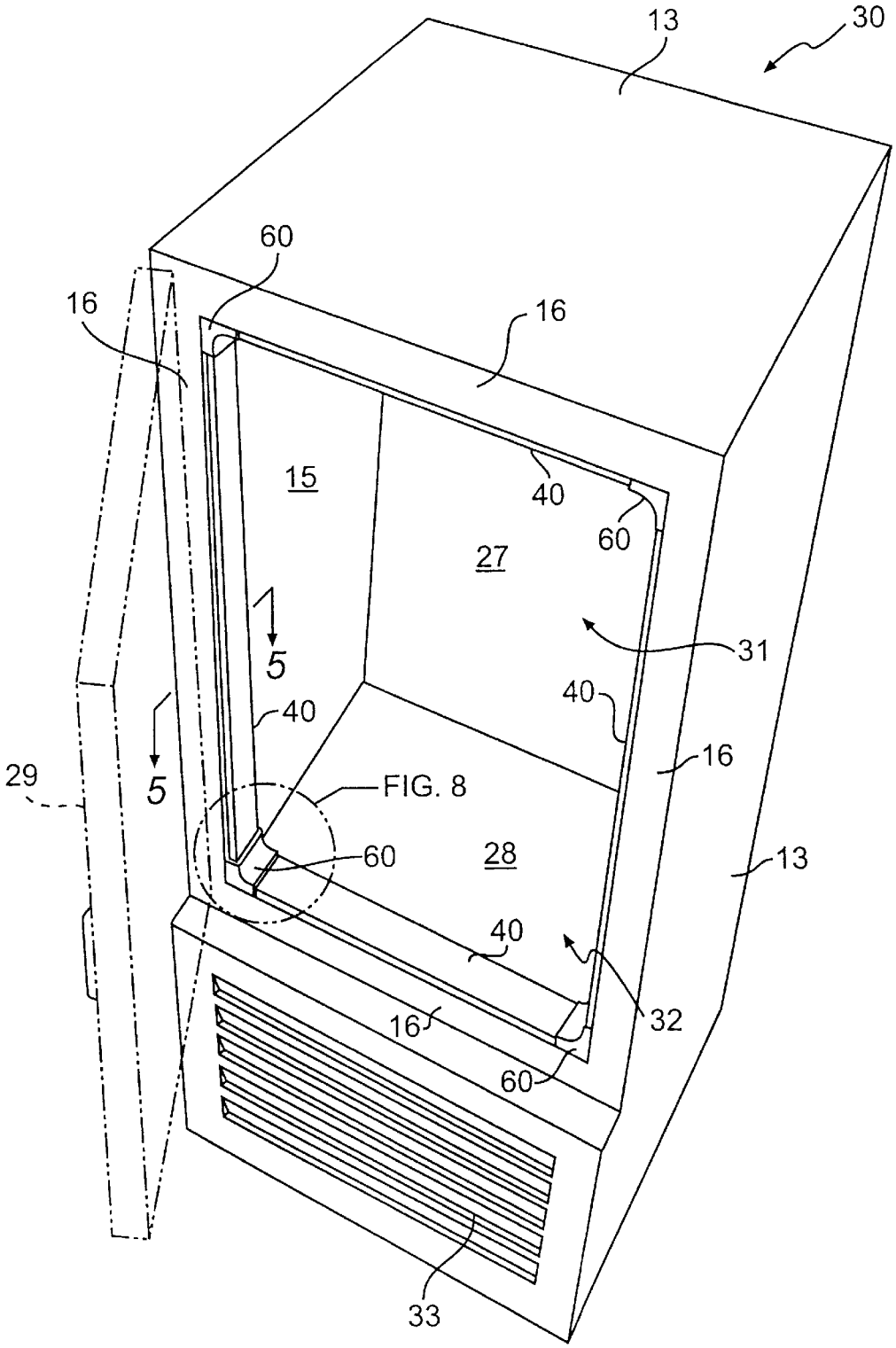
FIG. 1 illustrates an elevated front perspective view of an embodiment of a refrigeration unit of the present invention.

Reference now will be made in detail to the presently preferred embodiments of the invention, one or more examples of which are illustrated in the accompanying drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment, can be used on another embodiment to yield a still further embodiment. Thus, it is intended that the present invention cover such modifications and variations as come within the scope of the appended claims and their equivalents. Repeat use of reference characters throughout the present specification and appended drawings is intended to represent the same or analogous features or elements of the invention.

In accordance with the present invention, a refrigeration unit with a thermal break member and an anti-sweat heating mechanism in the form of a heater wire suitable for high humidity environments is generally indicated in FIG. 1 by the designating numeral 30. The precise configuration of the refrigeration unit may come in any number of forms, but for purposes of the present invention, each such embodiment has a thermal break member in accordance with the present invention. Thus, so long as the refrigeration unit is provided with the aforementioned thermal break member, it can be considered a preferred embodiment of the refrigeration unit in accordance with the present invention.

The structure and operation of the components of the refrigeration unit other than the thermal break member, can be conventional for such refrigeration units provided for high humidity environments, and therefore the description herein will concentrate on the thermal break member of the present invention.

Figure 5:
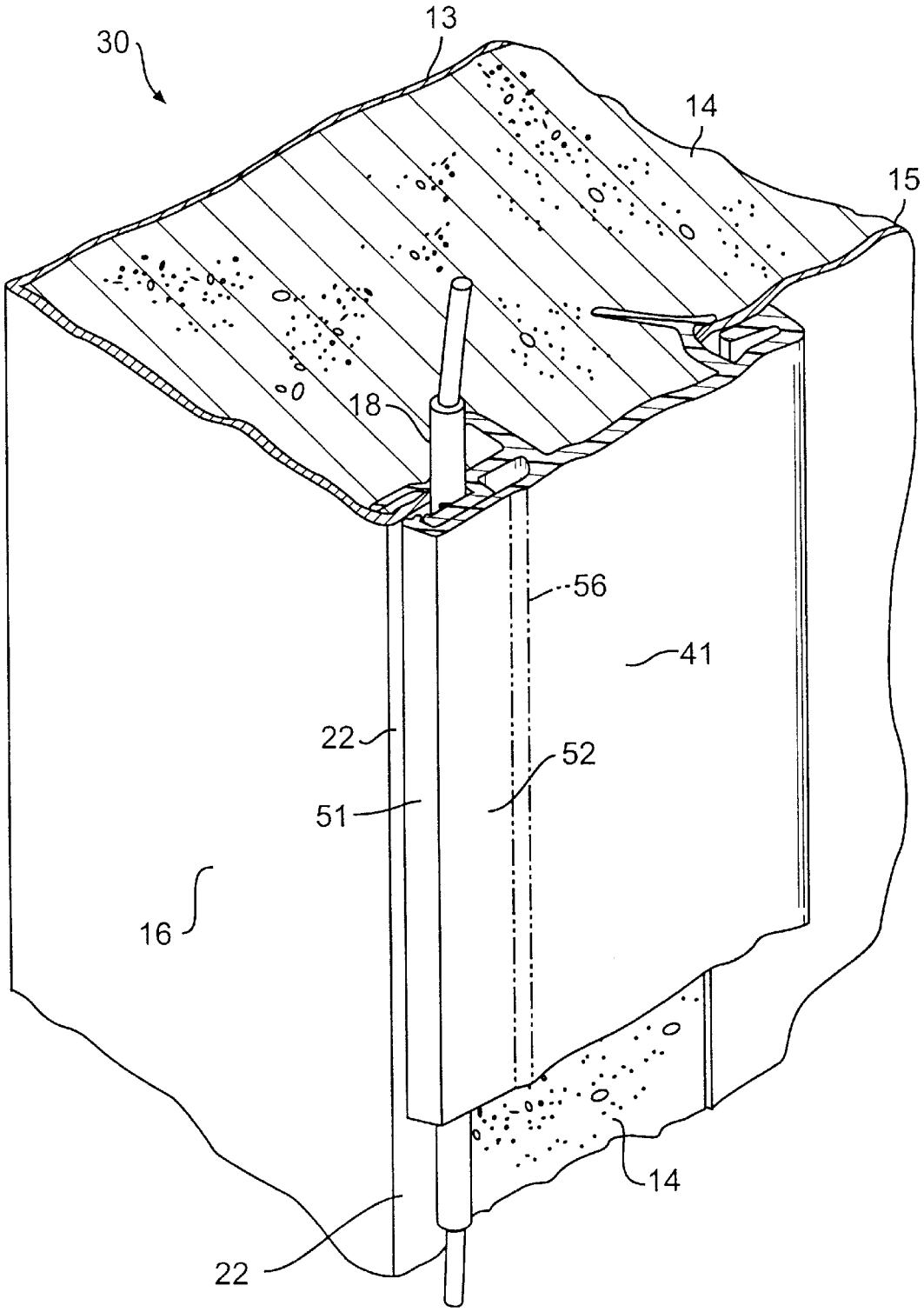
FIG. 5 is a view of sections of assembled components of an embodiment of a refrigeration unit of the present invention as if taken from the perspective looking along the direction of the arrows designated by the numerals 5 in FIG. 1.

As shown in FIG. 5, the outer shell of refrigeration unit 30 (indicated in FIG. 1) includes a typical exterior panel 13 formed of a layer of sheet metal. As indicated in FIG. 1, the refrigerated compartment 31 of refrigeration unit 30 is defined by a rear panel 27, a pair of opposed side panels 15 (only one is visible in the view of FIG. 1), a top panel (hidden in the view of FIG. 1), a bottom panel 28 and a front door 29 (indicated in phantom by the chain-dashed lines). As is conventional, the compartment panels that define the refrigerated compartment 31 of refrigeration unit 30 are formed of metal. A metal front panel 16 forms a border around the access opening 32 of the refrigerated compartment 31 and is exterior to the refrigerated compartment but in close proximity to side panel 15 and the other panels that define the refrigerated compartment. Heat-insulating material 14 is enclosed between the exterior panels (e.g., exterior panel 13) of the cabinet and the interior panels (e.g., side panel 15) that define the refrigerated compartment 31.

In the refrigeration unit 30 shown in FIG. 1, the refrigeration equipment that is provided and configured to refrigerate the refrigerated compartment 31, is disposed behind the front grillwork 33 of the cabinet. This refrigeration equipment is conventional and therefore is not illustrated herein. The refrigeration equipment is disposed within the cabinet beneath the bottom wall that defines the refrigerated compartment 31 and includes bottom panel 28. Thus, the refrigeration equipment is thermally isolated from the refrigerated compartment 31 by a wall construction similar to that shown in FIG. 5.

The present invention is not limited to refrigeration equipment disposed in the arrangement shown in FIG. 1. The refrigeration equipment can be disposed in any manner relative to the refrigerated compartment. For example, the refrigerated equipment can be above, below or remote from the refrigerated compartment. In some embodiments, the refrigerated equipment can be disposed at the rear of the cabinet and behind the refrigerated compartment.

A thermal break member configured in accordance with the present invention is provided to connect the panels that define the refrigerated compartment with the cabinet panels that form the border to the access opening of the refrigerated compartment. As shown in FIG. 1 for example, a thermal break member 40 in accordance with the present invention is configured and disposed to connect at least one compartment panel 15 and at least one cabinet panel 16 near access opening 32.

As shown in FIGS. 3–6 for example, thermal break member 40 includes a main body portion 41. In the presently preferred embodiment shown in FIGS. 3–6 for example, main body portion 41 is longer than it is wide and thus elongates lengthwise. The width of main body portion 41 spans most of the distance needed to connect the free edge of the panels defining the refrigerated compartment 31 with the inner flange 22 of front panel 16 of the cabinet forming the refrigeration unit 30.

Figure 6:
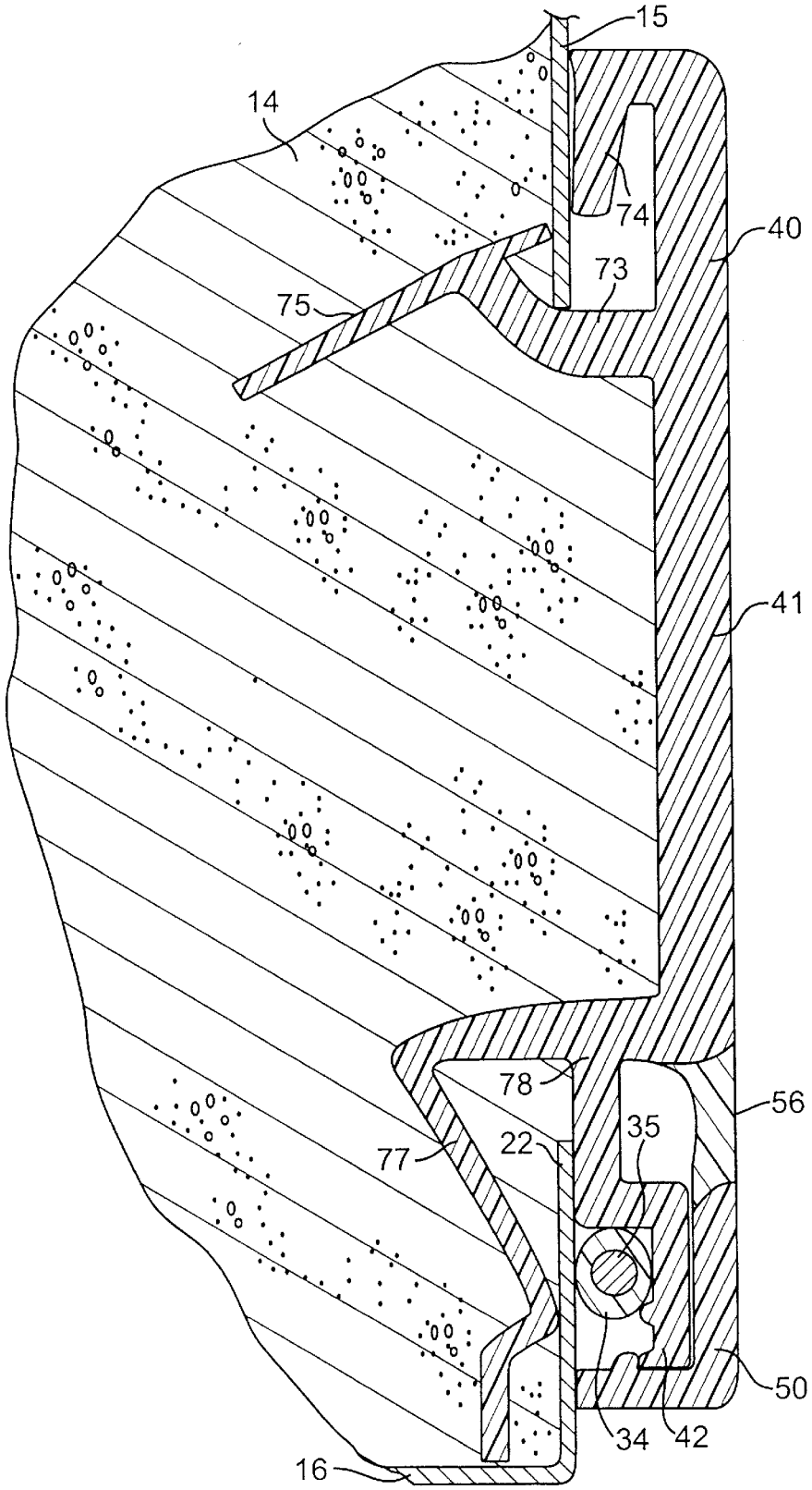
FIG. 6 illustrates a partial cross-sectional view of the components shown in FIG. 5.

As shown in cross-section in FIG. 6, the rearward portion of main body portion is configured with a forward leg portion 73 and a rearward leg portion 74. The section of compartment panel 15 near the free edge of panel 15 is held between forward leg 73 and rearward leg 74. Moreover, forward leg 73 has an anchor portion 75 that extends inwardly between side panel 15 and the exterior cabinet panel 13 (not shown in FIG. 6) and becomes embedded within the heat-insulating material 14.

Figure 7:
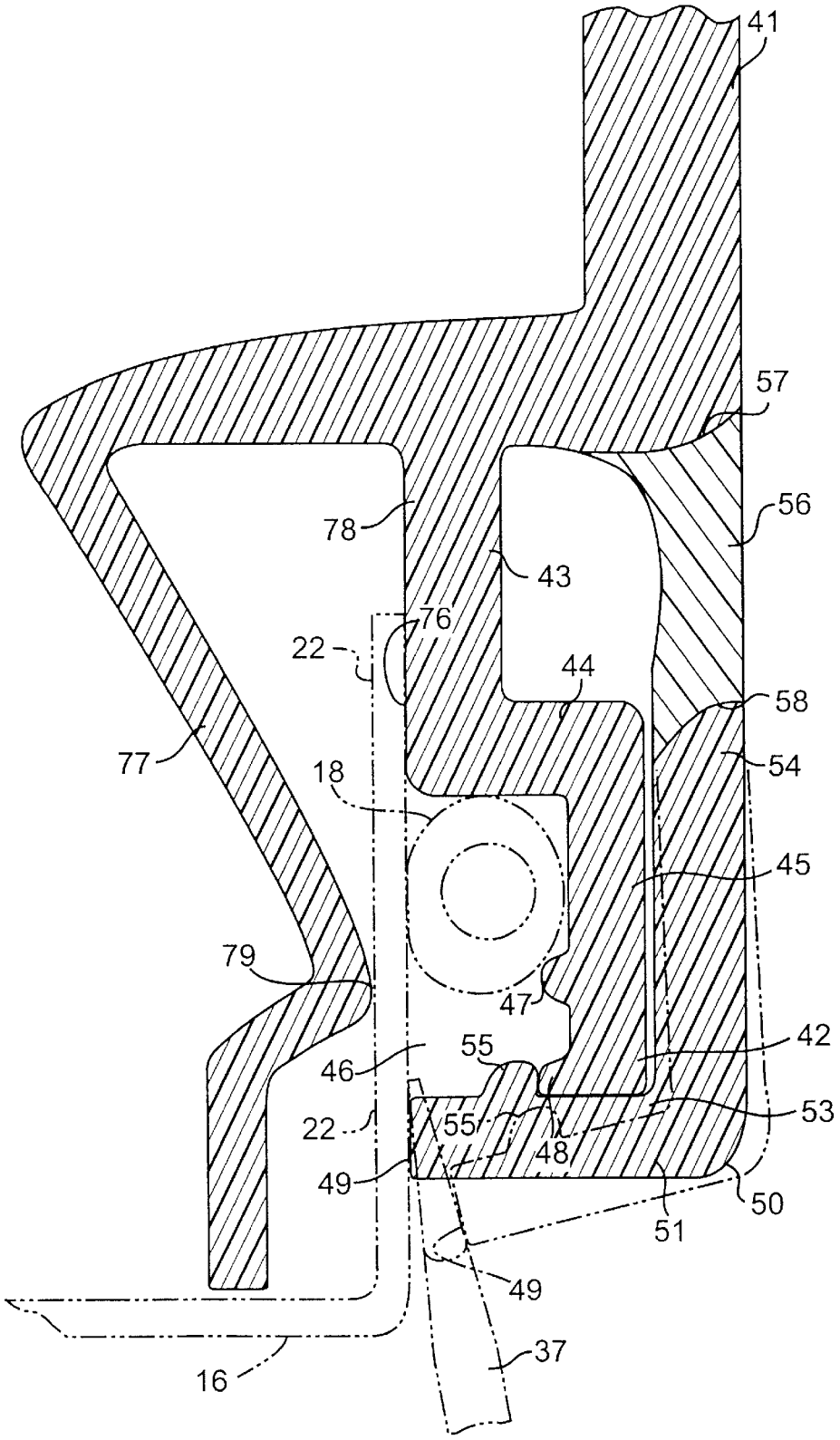
FIG. 7 illustrates a detail cross-sectional view of a portion of the thermal break member component of FIGS. 3 and 4 with the heater wire and a section of the front panel depicted in phantom by the dashed lines.

Similarly, as shown in FIG. 7, the forward portion of the main body portion includes a front flange 77 that extends in a direction generally parallel to the width of the main body portion. A rear flange 78 is configured to resiliently oppose front flange 77 in a manner that permits inner flange portion 22 of front panel 16 of the cabinet to be received between the outer surface 79 of front flange 77 and the forward edge portion 76 of rear flange 78.

Moreover, as shown in FIG. 6 for example, front flange 77 becomes embedded within heat-insulating material 14 and serves to anchor thermal break member 40 in place between the flange portion 22 of front panel 16 and the cabinet panel 13 (not shown in FIG. 6) in the vicinity of the access opening to the refrigerated compartment. Similarly, rear flange 73, and particularly anchor portion 75, becomes embedded within heat-insulating material 14 and also serves to further anchor thermal break member 40 in place between the refrigerated compartment's side panel 15 of the refrigerated compartment and the cabinet's outer panel.

Figure 3:
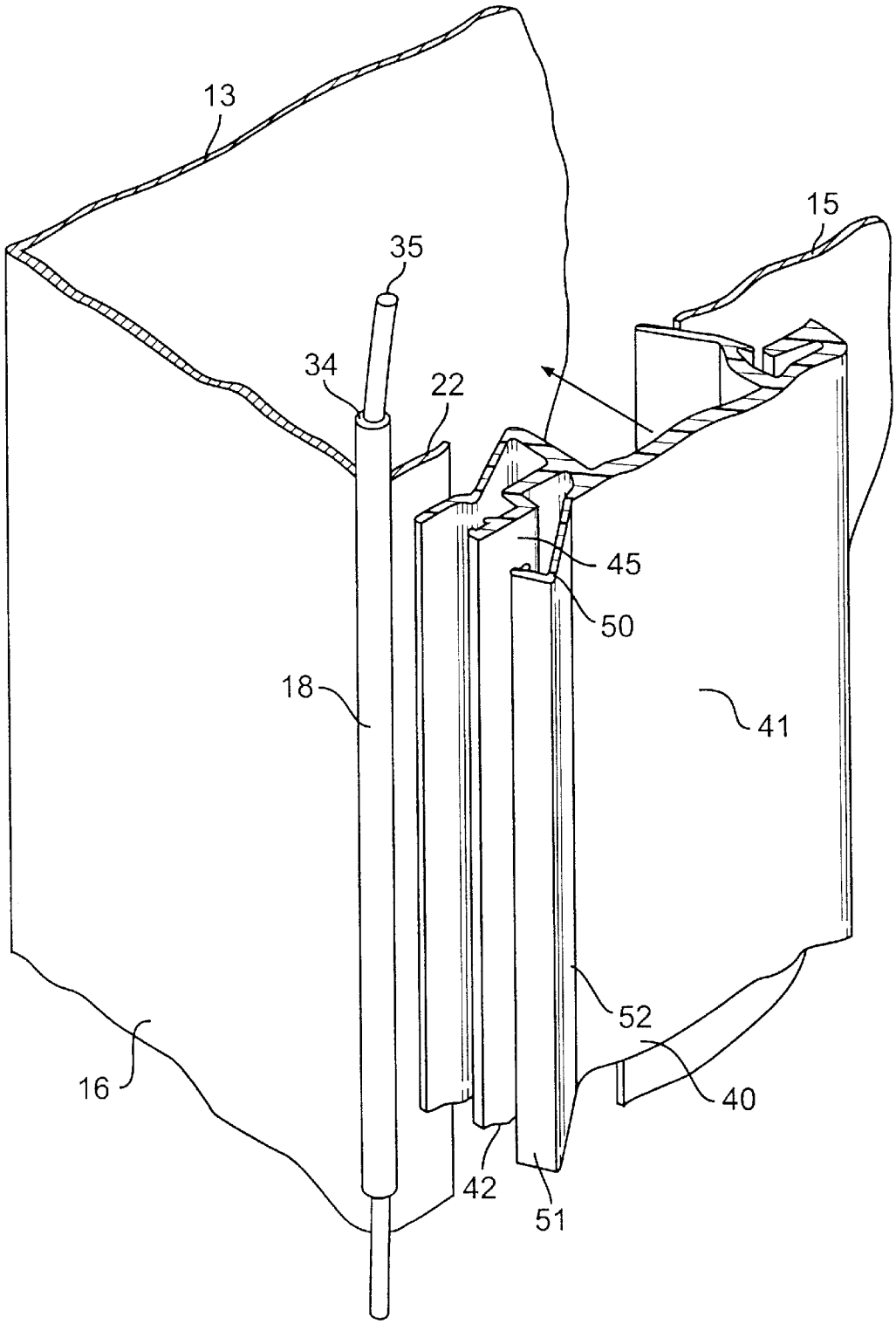
FIG. 3 illustrates an elevated front perspective view of sections of unassembled components of an embodiment of a refrigeration unit of the present invention.
Figure 4:
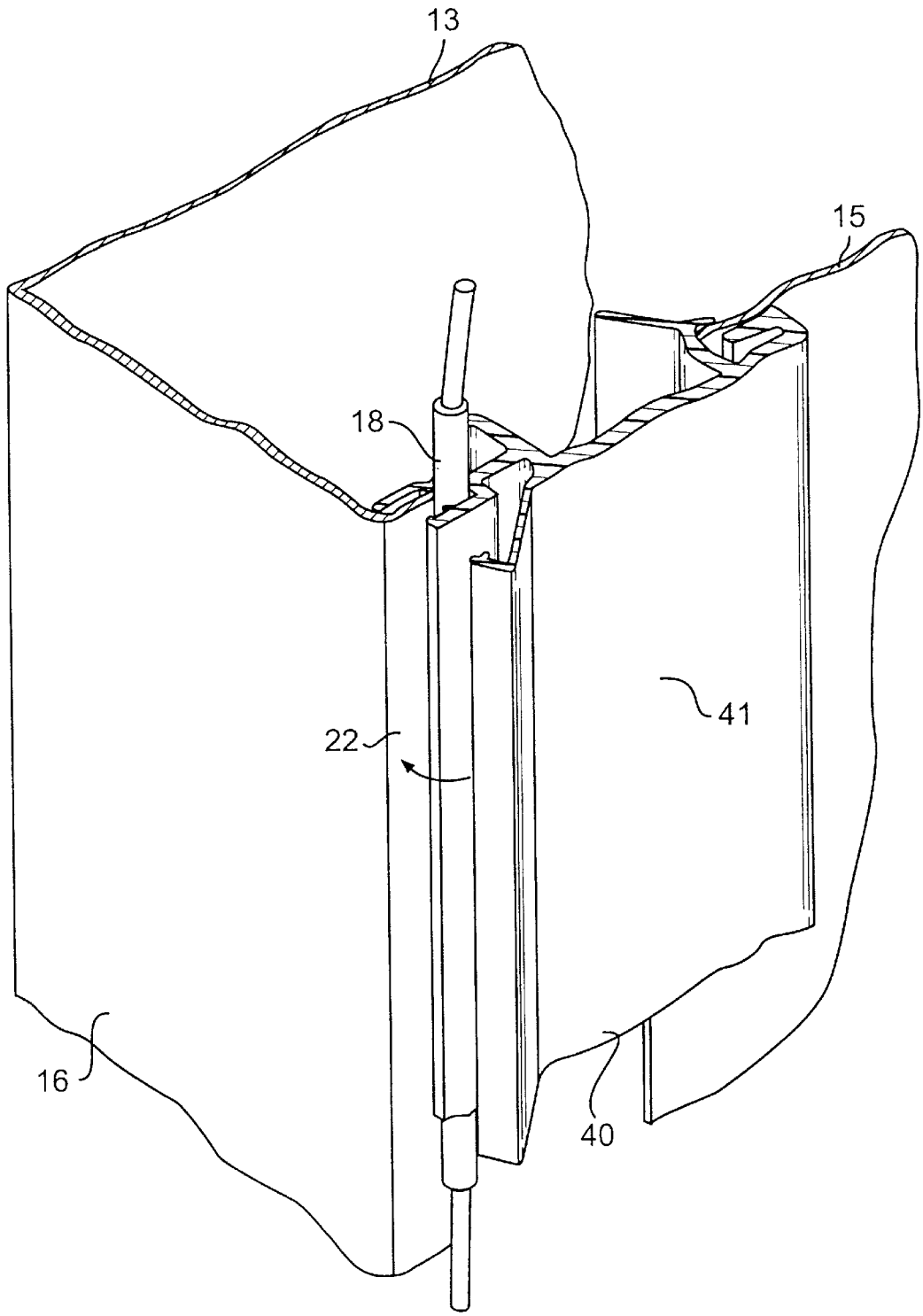
FIG. 4 is a view similar to that of FIG. 3 except that the components are in their assembled orientation.

As shown in FIG. 3 for example, thermal break member 40 includes a conduit portion 42 that is connected to the main body portion 41. As shown in FIG. 7 for example, a conduit portion is formed at one end of a conduit flange 43 extending parallel to main body portion 41. Conduit portion 42 is formed in part by a forwardly extending leg 44 that is disposed generally at a right angle from one end of front flange 22 of front panel 16. A second leg 45 that extends in a manner parallel to front flange 22 and in the direction of the width of main body portion 41, extends from the end of the forwarding extending leg 44. The two legs 44, 45 of the conduit portion combine to define a channel 46 that is disposed near the access opening 32 of refrigerated compartment 31 and configured to receive the heater wire 18.

As shown in FIG. 7, a retention rib 47 can be provided to retain heater wire 18 within channel 46. Retention rib 47 is formed on the channel surface of second leg 45 of the conduit portion. A series of aligned bosses also can be used in place of retention rib 47 to perform this wire retention function.

As shown in FIGS. 3 and 6 for example, heater wire 18 includes a sheath portion 34 that surrounds the metallic wire 35 that carries the electric current through heater wire 18. As is conventional, sheath portion 34 is formed of electrically-insulating material.

In accordance with the present invention, the thermal break member includes a closure member that is configured to close the opening to the channel formed by the conduit portion of the thermal break member. The closure member must be able to be selectively moved between an open position wherein the closure member permits access to the channel of the conduit portion so as to permit removal and replacement of the heater wire. The closure member also must be configured so that it can be disposed in a closed position wherein the closure member secures the channel of the conduit portion so as to retain therein any heater wire received therein. In this way, as shown in FIG. 6 for example, the closure member 50 also performs the aesthetic function of shielding the heater wire from view.

As embodied herein and shown in FIGS. 3 and 7 for example, the closure member defines a closure flap 51 and a closure leg 52. As shown in FIG. 7 for example, closure leg 52 defines a forward end 53 and a back end 54 disposed opposite forward end 53. Forward end 53 of closure leg 52 is connected to one end of closure flap 51. As shown in FIG. 7 for example, a latching rib 55 is defined by the closure member along the inside surface of closure flap 51 and elongating along the length thereof. As shown in FIG. 7, latching rib 55 is configured and disposed to engage second leg 45 of the conduit portion of the thermal break member when the closure member is disposed in the closed position so as to secure channel 46 of the conduit portion.

In accordance with the thermal break member of the present invention, a flexible hinge portion 56 is provided. As shown in FIG. 7 for example, flexible hinge portion 56 has a first end 57 connected to the main body portion 41 and a second end 58 connected to the closure member. The closure member is selectively movable about flexible hinge portion 56 between the open position and the closed position of the closure member. Main body portion 41, flexible hinge portion 56 and closure member 50 of the thermal break member are preferably configured in a unitary construction. Desirably, thermal break member 40 is formed of polyvinylchloride. However, the durometer of flexible hinge portion 56 differs from the durometer of the closure member 50 and the main body portion 41 of thermal break member 40. In a presently preferred embodiment of the thermal break member 40 of the present invention, a typical value for the durometer of flexible hinge portion 56 is 70 Shore A, and a typical value for the durometer of main body portion 41 and closure member 50 is 80 Shore D.

Figure 8:
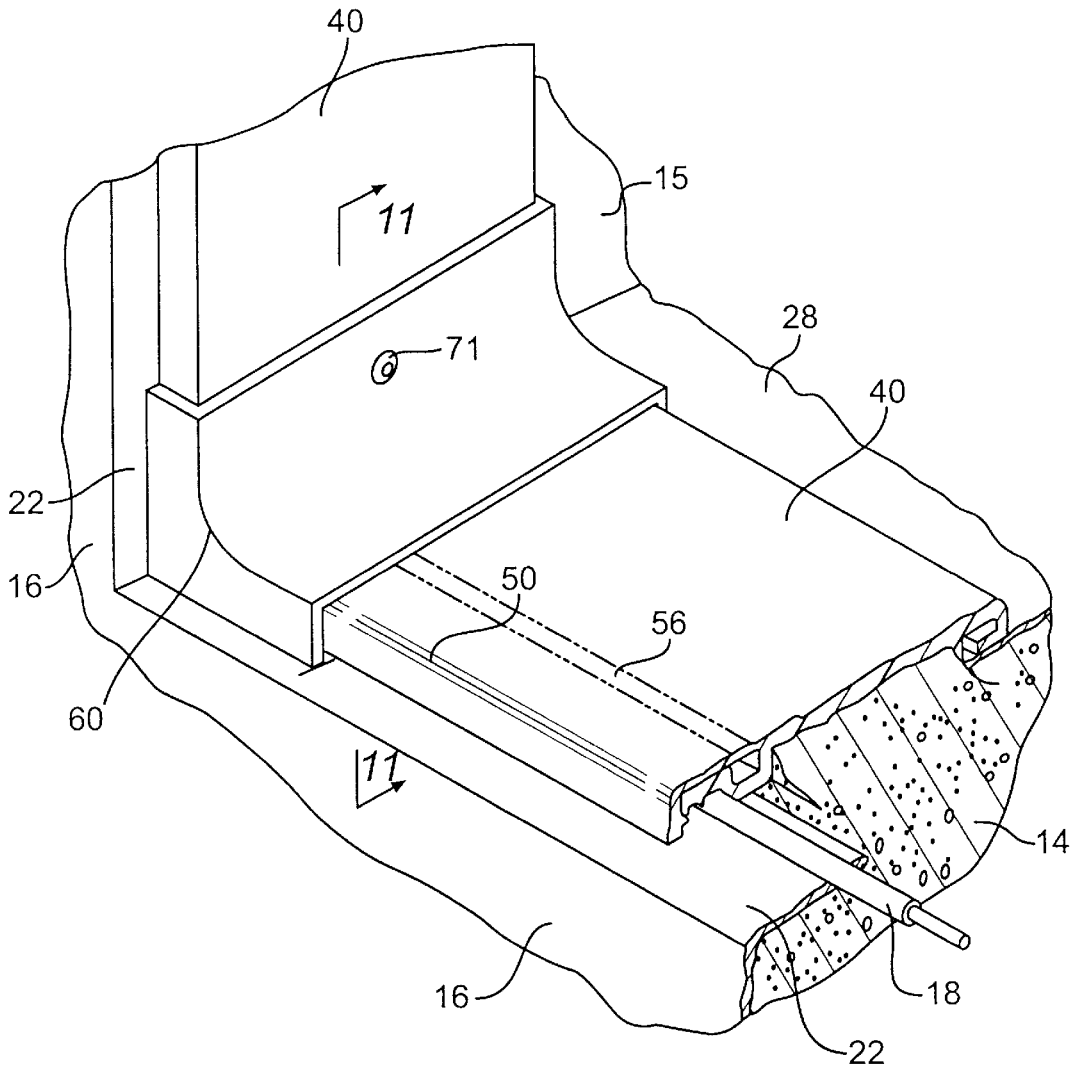
FIG. 8 illustrates an elevated front perspective view of the detail in the balloon designated by the numeral 8 in FIG. 1.
Figure 9:
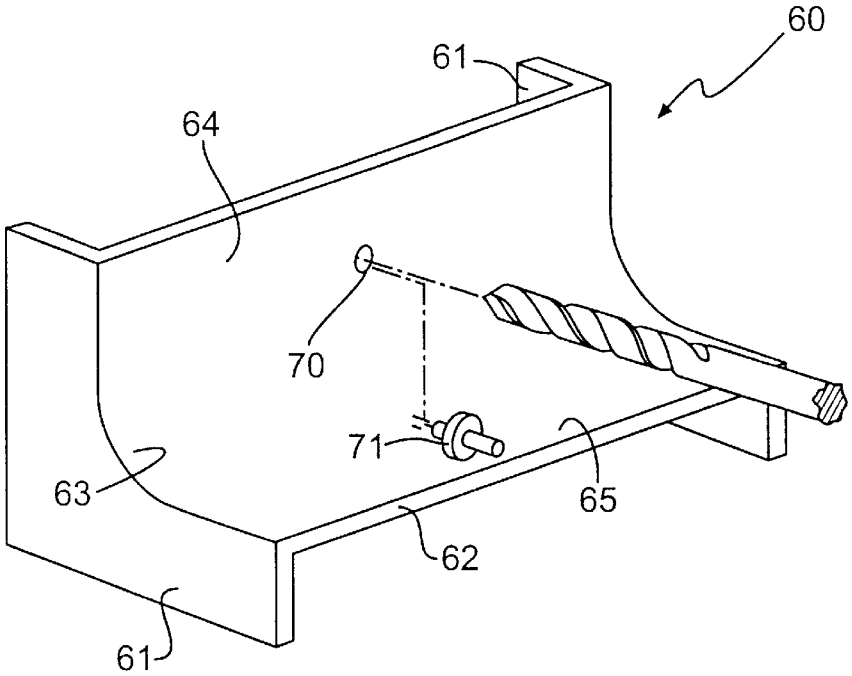
FIG. 9 illustrates an elevated front perspective view of the a component shown in FIG. 8.
Figure 10:
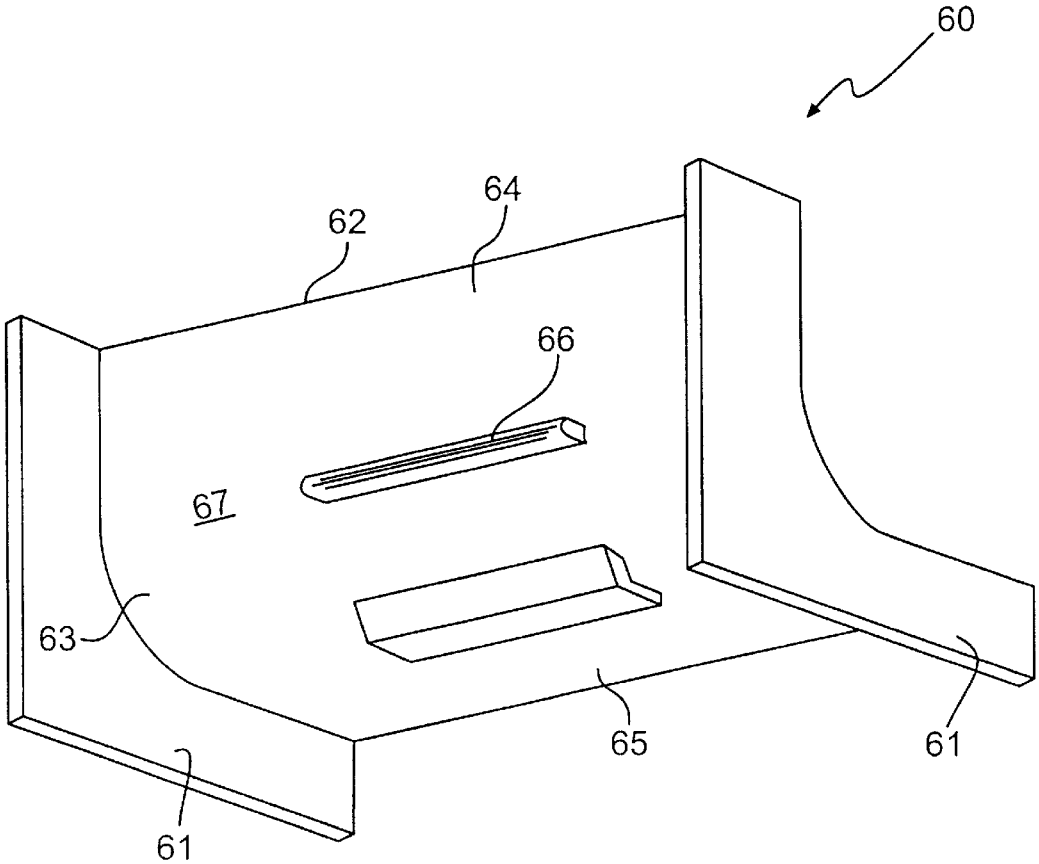
FIG. 10 illustrates an elevated rear perspective view of the component shown in FIG. 9.
Figure 11:
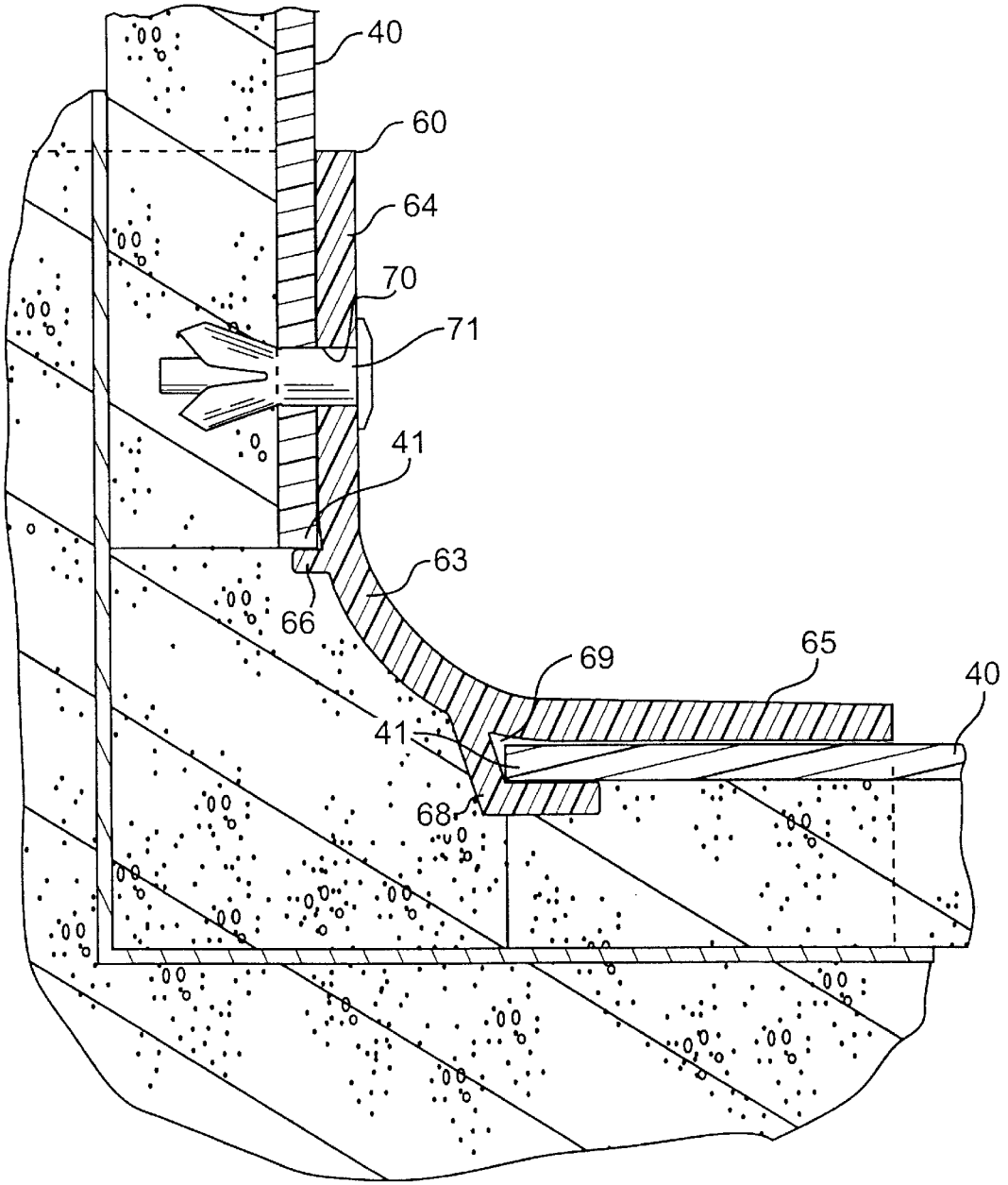
FIG. 11 illustrates a partial cross-sectional view taken in the direction of the arrows designated by the numerals 11 in FIG. 8.

In accordance with the present invention, corner pieces are provided to join the ends of two thermal break members in the corners of the refrigerated compartment. As shown in FIGS. 1, 8 and 11, each corner piece 60 covers the free ends of two adjoining thermal break members 40. As shown in FIGS. 9 and 10 for example, each corner piece 60 is configured with a pair of opposed side members 61, which are joined by a saddle member 62 that extends between side members 61 by the width of the thermal break member 40. Saddle member 62 has a centrally located radiused portion 63 bounded at one edge by a generally planar top portion 64 and at the opposite edge by a generally planar bottom portion 65.

As shown in FIG. 10, a positioning rib 66 extends from the rear surface 67 of saddle member 62 of corner piece 60 in the vicinity of where top portion 64 joins radiused portion 63. Positioning rib 66 is configured to locate the free edge of main body portion 41 of thermal break member 40.

A sleeve member 68 is located on the rear surface 67 of saddle member 62 in the vicinity of where radiused portion 63 meets bottom portion 65. As shown in FIG. 11, sleeve member 68 is configured to form a slot 69 that receives the free edge of main body portion 41 of thermal break member 40. As shown in FIG. 9, a hole 70 can be drilled through top portion 64 of saddle member 62 to receive a fastening member such as a rivet 71. As shown in FIG. 11, a rivet 71 is inserted into the hole 70 formed in top portion 64 of saddle member 62 and through the end of main body portion 41 of the adjacent thermal break member 40. Thus, corner pieces 60 interlock the adjoining thermal break members 40.

As shown in FIG. 8 for example, the positioning of corner pieces 60 acts to prevent dislodgment of closure members 50 of the adjoining thermal break members 40. Thus, replacement of heater wire 18 would begin by drilling out rivet 71 such as shown in FIG. 8 for example, and removing corner piece 60 at each end of the thermal break member 40 deemed to contain the faulty heater wire 18.

Referring to FIGS. 3 and 7 for example, once corner members 60 at each opposite end of the targeted thermal break member 40 are removed, then replacement of heater wire 18 requires disengagement of closure member 50 from second leg 45 of conduit portion 42 of thermal break member 40. This is accomplished as shown in FIG. 7 by inserting a wedge such as a screwdriver blade 37 (shown in phantom by the dashed lines) between the free edge 49 of closure flap 51 and the surface of flange portion 22 of front panel 16 with sufficient force to dislodge latching rib 55 from its friction fit engagement with the free end 48 of second leg 45 of conduit portion 42. Once closure flap 51 is disengaged, the malfunctioning heater wire 18 can be removed and replaced with a new heater wire 18. Thereafter, closure flap 51 can be closed over the opening of channel 46 of conduit portion 42 and locked to second leg 45 of conduit portion 42 by the application of sufficient force to deform the mating components of latching rib 55 and free edge 48 of second leg 45 of conduit portion 42 until they interlock with one another.

Then each corner piece 60 can be replaced by first engaging sleeve member 68 on the edge of one adjoining thermal break member 40 and then pushing top portion 64 of corner piece 60 against the adjoining thermal break member 40 with positioning rib 66 locating the free edge of the underlying thermal break member 40 as shown in FIG. 11. Once corner piece 60 is located in the proper position, hole 70 can be drilled through top portion 64 and a concentric hole can be drilled through the underlying main body portion 41. Then a rivet 71 can be used to fasten the corner piece in place.

Figure 2A:
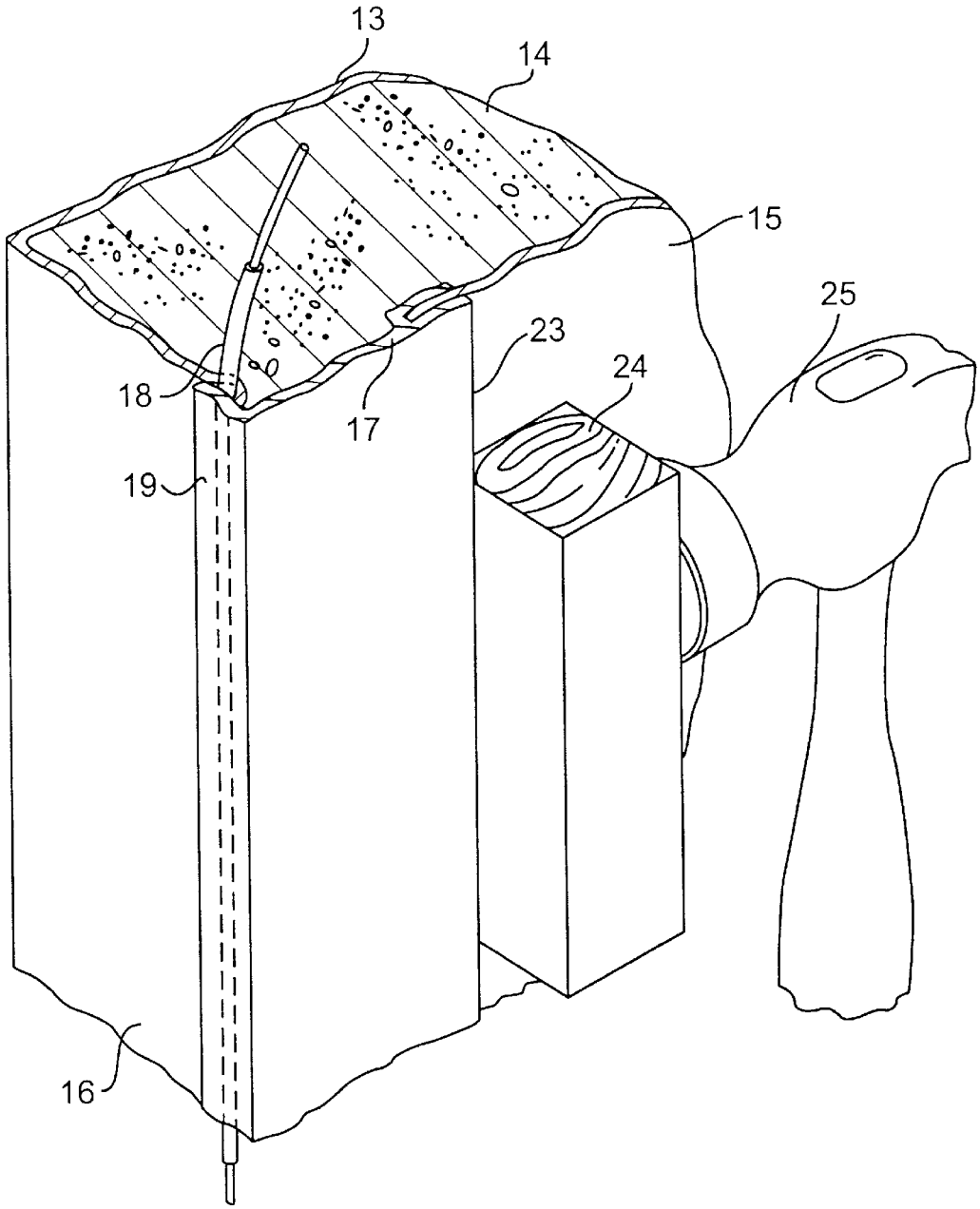
FIG. 2A PRIOR ART
FIGS. 2A, 2B and 2C are views taken of three different prior art refrigeration units as if from the perspective shown in FIG. 1 along the lines 5—5 of FIG. 1.
Figure 2B:
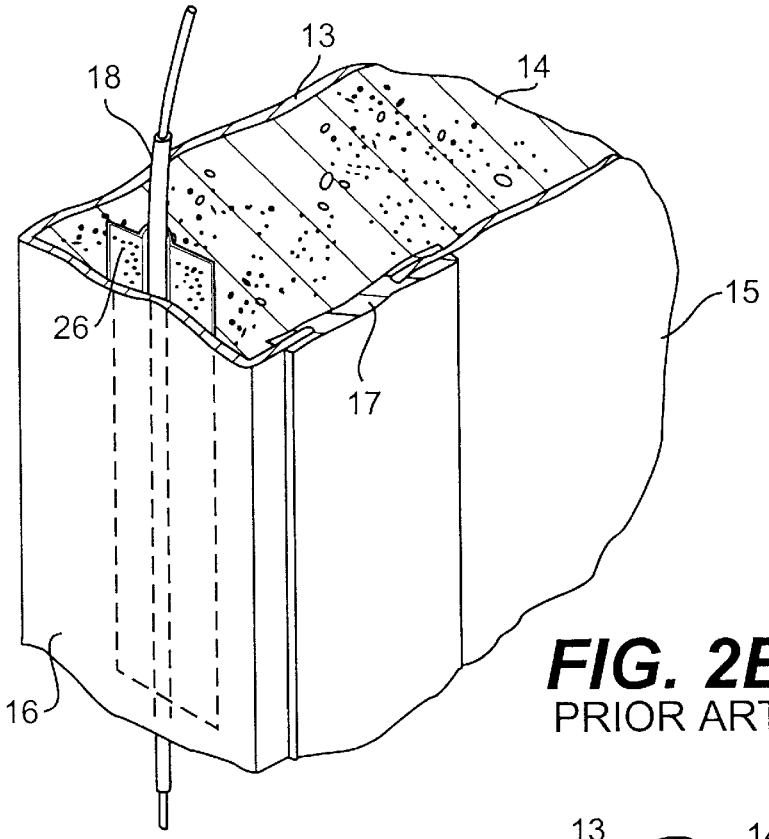
FIG. 2B PRIOR ART
Figure 2C:
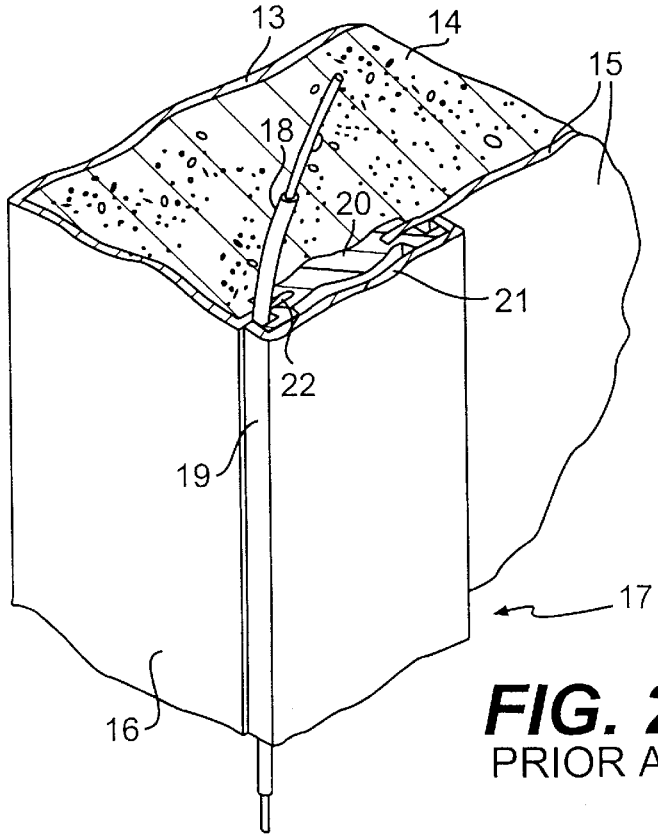
FIG. 2C PRIOR ART

Replacement of heater wire 18 in the embodiments of the present invention can be accomplished without destroying the thermal break member and in a much faster manner than is possible with the embodiments shown in FIG. 2A, 2B or 2C. Moreover, the two-piece thermal break member 17 shown in FIG. 2C is much more expensive to manufacture due to the need for precise tolerances in order to effect the proper interlock between the two components 20 and 21. Similarly, the assembly process for the refrigeration unit shown in FIG. 2C requires an additional step to attach the thermal break cap 21 to panel component 20. In addition, manufacturing of the refrigeration unit shown in FIG. 2C is rendered more complicated and therefore more costly due to the need to inventory two separate components 20 and 21 for thermal break member 17.

Thus, the present invention fills the need for a thermal break member that is less costly to install and maintain, and at the same time facilitates replacement of the heater wire in a manner that is economical. Such replacement can be done in the field with relatively little skill by the repair person, without requiring large amounts of the repair person's time, and without destruction of the thermal break member in the process of replacement of the heater wire.

What is claimed is:

1. A refrigeration unit suitable for high humidity environments with a thermal break member and an anti-sweat heating mechanism in the form of a heater wire, the unit comprising:

a) a cabinet;

b) a refrigerated compartment disposed within said cabinet and defining an access opening, said access opening being configured and disposed to provide access to said refrigerated compartment;

c) refrigeration equipment configured to refrigerate said refrigerated compartment, said refrigeration equipment being disposed within said cabinet and thermally isolated from said refrigerated compartment;

d) at least one compartment panel defining a portion of said refrigerated compartment disposed near said access opening;

e) at least one cabinet panel defining a portion of said cabinet and disposed near said access opening;

f) a thermal break member configured and disposed to connect said at least one compartment panel and said at least one cabinet panel near said access opening, said thermal break member including:

i) a main body portion;

ii) a conduit portion connected to said main body portion, said conduit portion defining a channel disposed near said access opening and configured to receive therein the heater wire;

iii) a closure member;

iv) a flexible hinge portion, said flexible hinge portion having a first end connected to said main body portion and a second end connected to said closure member; and v) said closure member being configured and to be selectively movable about said flexible hinge portion between an open position and a closed position, wherein said closure member secures the channel so as to retain therein any heater wire received therein when said closure member is disposed in said closed position, and wherein said closure member permits access to said channel so as to permit replacement of the heater wire configured to be received therein when said closure member is disposed in said open position.

2. An apparatus as in claim 1, wherein said main body portion, said flexible hinge portion and said closure member of said thermal break member are configured in a unitary construction.

3. An apparatus as in claim 2, wherein said flexible hinge of said thermal break member has a durometer of about 70 Shore A.

4. An apparatus as in claim 3, wherein at least one of said main body portion and said closure member of said thermal break member has a durometer of about 80 Shore D.

5. An apparatus as in claim 1, further comprising:

vi) a rib defined by said closure member; and vii) wherein said rib is configured and disposed to engage said conduit portion when said closure member secures the channel so as to retain therein any heater wire received therein when said closure member is disposed in said closed position.

6. An apparatus as in claim 1, wherein:

vi) said closure member defining a closure flap and a closure leg, said closure leg defining a first end and a second end disposed opposite said first end, said first end of said closure leg being connected to said closure flap; and vii) said flexible hinge portion having a second end disposed generally opposite said first end and connected to said closure leg.

7. An apparatus as in claim 6, comprising:

viii) a rib defined by said closure flap; and ix) wherein said rib is configured and disposed to engage said conduit portion when said closure member secures the channel so as to retain therein any heater wire received therein when said closure member is disposed in said closed position.

8. An apparatus as in claim 1, wherein said thermal break member includes at least one anchor portion extending generally normally from said main body portion and toward said at least one cabinet panel.

9. An apparatus as in claim 1, further comprising:

g) a corner piece disposed in a corner of said refrigerated compartment and covering at least one end of said thermal break member.

10. An apparatus as in claim 9, wherein said corner piece includes a saddle member defining a centrally located radiused portion.

11. A thermal break member configured and disposed to connect at least one compartment panel of a refrigeration unit and at least one cabinet panel near an access opening of the refrigeration unit, said thermal break member comprising:

a) a main body portion;

b) a conduit portion connected to said main body portion, said conduit portion defining a channel disposed near said access opening and configured to receive therein a heater wire;

c) a closure member; and d) a flexible hinge portion, said flexible hinge portion having a first end connected to said main body portion and a second end connected to said closure member.

12. An apparatus as in claim 11, wherein said closure member is selectively movable between a closed position and an open position, wherein said closure member secures said channel so as to retain therein any heater wire received therein when said closure member is disposed in said closed position, and wherein said closure member permits access to said channel so as to permit replacement of the heater wire configured to be received therein when said closure member is disposed in said open position.

13. An apparatus as in claim 11, wherein said flexible hinge portion has a durometer of about 70 Shore A.

14. An apparatus as in claim 13, wherein at least one of said main body portion and said closure member has a durometer of about 80 Shore D.

15. An apparatus as in claim 11, further comprising:

f) a latching rib defined by said closure member;

g) wherein said latching rib is configured and disposed to engage said conduit portion when said closure member secures the channel so as to retain therein any heater wire received therein when said closure member is disposed in said first position.

16. An apparatus as in claim 11, wherein:

f) said closure member defining a closure flap and a closure leg, said closure leg defining a first end and a second end disposed opposite said first end, said first end of-said closure leg being connected to said closure flap; and g) said flexible hinge portion having a second end disposed generally opposite said first end and connected to said closure leg.

17. An apparatus as in claim 16, further comprising:

h) a latching rib defined by said closure flap; and i) wherein said latching rib is configured and disposed to engage said conduit portion when said closure member secures the channel so as to retain therein any heater wire received therein when said closure member is disposed in said first position.

* * * * *